US005934955A

United States Patent [19]

Heston

[11] Patent Number: 5,934,955

[45] Date of Patent: Aug. 10, 1999

[54] VERTICAL TRIM SYSTEM FOR MARINE OUTDRIVES

[76] Inventor: Scott J. Heston, 7919 11th Ave. South, St Petersburg, Fla. 33707

[21] Appl. No.: 09/014,135

[22] Filed: Jan. 27, 1998

[51] Int. Cl.[6] ..... B63H 5/12

[52] U.S. Cl. ..... 440/61; 440/57

[58] Field of Search ..... 440/53, 57, 61, 440/63, 54; 248/640–643

[56] References Cited

U.S. PATENT DOCUMENTS

| | | | |
|---|---|---|---|
| 2,737,920 | 3/1956 | Heath | 440/61 |
| 2,949,791 | 8/1960 | Cattaneo et al. | 440/63 |
| 3,181,495 | 5/1965 | Kiekhaefer | 440/57 |
| 4,673,358 | 6/1987 | Iwai et al. | 440/61 |
| 4,890,811 | 1/1990 | Ehni | 440/61 |
| 4,897,057 | 1/1990 | McCormick | 440/57 |
| 5,647,780 | 7/1997 | Hosoi | 440/57 |

*Primary Examiner*—Ed Swinehart
*Attorney, Agent, or Firm*—Arnold White & Durkee

[57] ABSTRACT

A vertical trim system for a marine inboard-outboard outdrive includes a transom plate defining an opening therethrough and having first and second sides, the first side adapted to be mounted to a boat transom. At least one arm includes first and second ends, the first end being pivotally coupled to the second side of the transom plate, such that the arm pivots about a horizontal axis. The second end of the arm is adapted to be pivotally coupled to a gimbal ring of an outdrive.

18 Claims, 6 Drawing Sheets

VERTICAL TRIM SYSTEM FOR MARINE OUTDRIVES

BACKGROUND OF THE INVENTION

1. Field of the Invention

The invention relates generally to marine inboard-outboard drive systems, and more particularly, to a vertical trim system for adjusting the vertical height of a marine outdrive.

2. Description of Related Art

Marine inboard-outboard drive systems are well known in the art. A typical inboard-outboard system includes an engine mounted inside a boat that is coupled to an outdrive unit through an opening in the boat transom. A transom plate is coupled to the boat's transom and a seal is provided to seal the opening. The transom plate further supports the outdrive system. The outdrive unit is coupled to the transom plate via a gimbal ring that pivots about a vertical pivot axis for steering purposes. The gimbal ring also allows the outdrive unit to pivot about a horizontal pivot axis for kick-back movement of the outdrive unit.

A driveshaft extends through the opening in the transom, with one end of the driveshaft coupled to the engine inside the boat, and the other end coupled to the outdrive unit so as to turn a propeller shaft. In known inboard-outboard systems, the driveshaft is coupled to the outdrive via a universal joint to allow the outdrive unit to pivot via the gimbal ring for steering or kick-back.

Propeller location is very significant in any marine drive system. A key principle for performance is that the propellers be located at their optimum depth in the water at all times, providing optimum efficiency, speed and control of the boat. A problem arises when mounting an outdrive of an inboard-outboard system to the transom of a boat. Outdrives are fixed at the engine crankshaft height. Once the outdrive is secured to the transom, it is not vertically adjustable. Therefore, the propeller depth also may not be adjusted once the outdrive unit is secured to the transom. When installing an inboard-outboard drive system, an optimum propeller depth relative to the boat is determined. Then, the system is installed such that the propeller is located at this optimum depth. This propeller depth, however, is only "optimum" for a given set of conditions, since the optimum propeller depth changes as conditions change.

Several factors affect the propeller depth necessary for optimum boat performance. For example, the total weight and center of gravity of the boat changes as fuel is consumed or the number of passengers changes. Sea conditions also affect the desired propeller location—a propeller depth that is appropriate for calm seas likely will not provide optimum performance in choppy seas. Thus, the "optimum" propeller depth calculated prior to installing the outdrive is a compromise, at best. This problem is magnified in dual-drive system boats that have a V-hull design. Since the engines are placed side-by side, they are located higher above the water line in order to fit into the V-hull. The propellers, in turn, are also mounted higher, affecting the trim capability of the boat.

Unfortunately, no satisfactory solution to the above described problem exists in the prior art. In one attempted solution, spacer blocks are placed between the outdrive upper case and lower foot, effectively extending the depth of the outdrive unit, thereby extending the propeller further into the water. Spacers, however, cannot be used to raise the propeller height relative to the boat. Moreover, adding or removing spacers is a complicated and time-consuming undertaking, and if conditions change, the boat's driver cannot change the propeller depth while the boat is underway.

Another attempted solution uses a "set-back," or spacer box. The outdrive is mounted on the spacer box, which is located between the boat's transom and the outdrive gimbal ring, rather than mounting the outdrive directly to the transom. The position of the spacer box may be manually adjusted to a small degree, which in turn, allows the propeller depth to be varied slightly. However, as with the spacer blocks, the propeller depth may be varied only a small amount, and the process is time consuming and expensive. Furthermore, the box assembly cannot be adjusted for changing conditions while the boat is underway.

The present invention addresses these, and other, shortcomings of prior art marine outdrive systems.

SUMMARY OF THE INVENTION

In one aspect of the present invention, a vertical trim system for a marine inboard-outboard outdrive includes a transom plate that has first and second sides, with the first side adapted to be mounted to a boat transom. The vertical trim system further includes at least one arm having first and second ends. The first end is pivotally coupled to the second side of the transom plate, such that the arm pivots about a horizontal axis. The second end of the arm is adapted to be pivotally coupled to a gimbal ring.

In another aspect of the invention, a marine outdrive system for an inboard-outboard propulsion unit includes a transom plate defining an opening therethrough. The transom plate has first and second sides, with the first side adapted to be mounted to a boat transom. The outdrive system further includes an outdrive unit that has a gimbal ring, and a driveshaft that includes first and second ends. The first end is adapted to extend through the transom plate opening and be coupled to an engine, the second end is coupled to the outdrive unit via a constant velocity joint. First and second arms each have first and second ends, with the first ends being pivotally coupled to the second side of the transom plate in spaced relationship, such that the first and second arms pivot about first and second horizontal axes, respectively. The first axis is generally parallel to the second axis, and the second ends of the first and second arms each are coupled to the gimbal ring.

In yet another aspect of the present invention, a method is provided for adjusting the depth of an outdrive propeller for an inboard-outboard boat propulsion system. The propulsion system includes a transom plate coupled to a boat transom, an engine mounted inside a boat, and a gimbal ring pivotally coupled to the outdrive. The method includes the acts of coupling one end of a driveshaft to the engine via a universal joint and the other end of the driveshaft to the outdrive via a constant velocity joint, pivotally coupling one end of an arm to a location on the transom plate and the other end to the gimbal ring, and pivoting the arm about the location on the transom plate to adjust the height of the outdrive.

BRIEF DESCRIPTION OF THE DRAWINGS

Other objects and advantages of the invention will become apparent upon reading the following detailed description and upon reference to the drawings in which.

Figure 1:
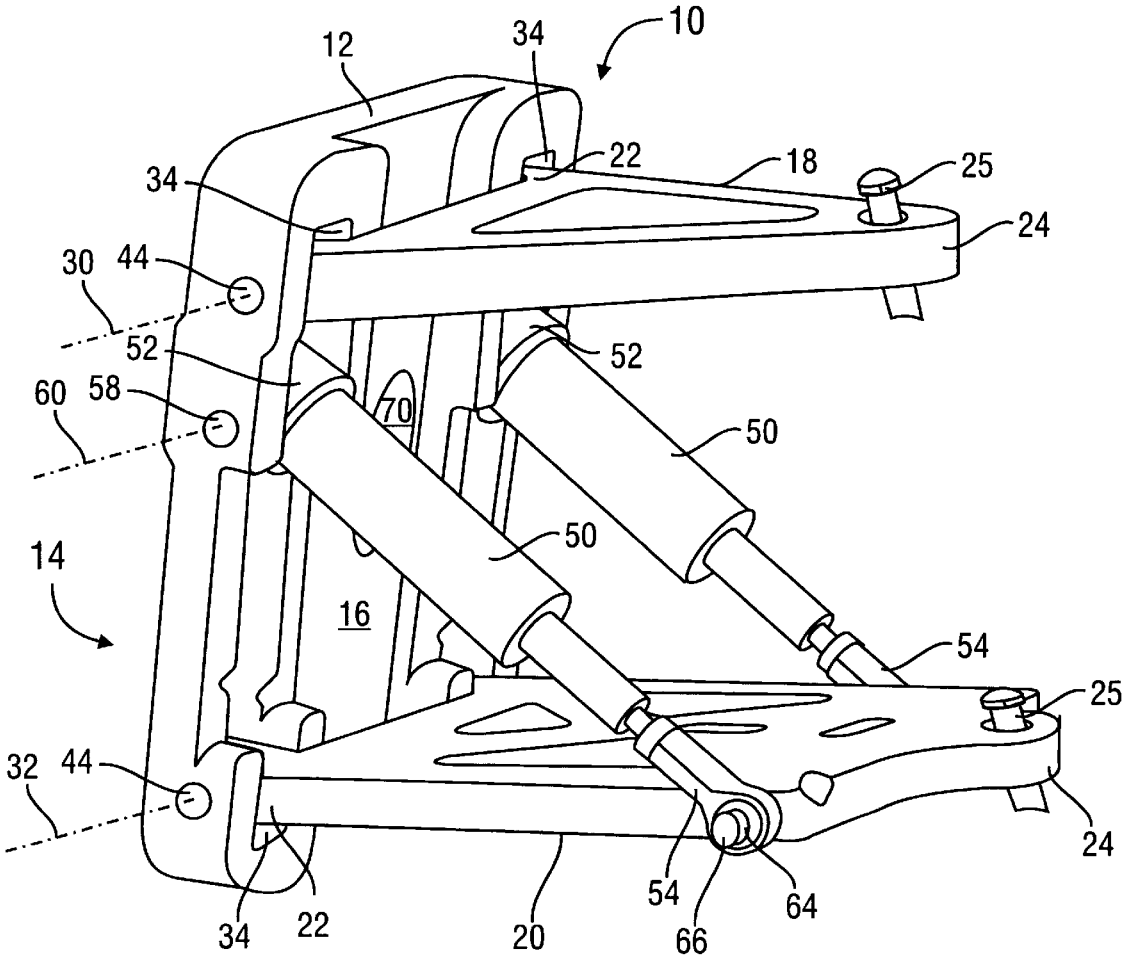
FIG. 1 is a perspective view of a vertical trim system for a marine outdrive in accordance with an embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

FIG. 1 illustrates an embodiment of a marine outdrive vertical trim system 10 in accordance with the present invention. The vertical trim system 10 includes a transom plate 12 having one side 14 adapted to be coupled to a boat transom (not shown in FIG. 1). The transom plate 12 provides support for first and second arms 18, 20, each of which has one end 22 pivotally coupled to a second side 16 of the transom plate 12 in a spaced relationship. The opposite ends 24 of the first and second arms 18, 20 are adapted to be coupled to a gimbal ring of a marine outdrive (not shown in FIG. 1). The gimbal ring rotates about a vertical axis for steering purposes, and allows the outdrive to pivot about a horizontal axis for kick-back motion. In one embodiment, the ends 24 of the first and second arms 18, 20 each include a pivoting joint 25 for coupling the first and second arms 18, 20 to a gimbal ring, such that the gimbal ring may move vertically (up and down) with the first and second arms 18, 20, and still rotate about a vertical axis for steering. Other movement of the gimbal ring relative to the first and second arms 18, 20 is thus inhibited, though the gimbal ring still allows an outdrive coupled thereto to pivot about a horizontal axis for kick-back movement.

In the embodiment illustrated in FIG. 1, the first arm 18 is situated above the second arm 20. The first and second arms 18, 20 may be coupled to the transom plate 12 in any manner that allows the first and second arms 18, 20 to pivot about first and second horizontal axes 30, 32, respectively, such that the vertical position of the ends 24 may be varied. The first horizontal axis 30 is generally parallel to the second horizontal axis 32, so that the ends 24 of the first and second arms 18, 20 move along a generally common vertical axis when their vertical position is varied. In other words, the ends 24 adapted to be coupled to the gimbal ring may be moved up and down, but not side-to-side.

Figure 2:
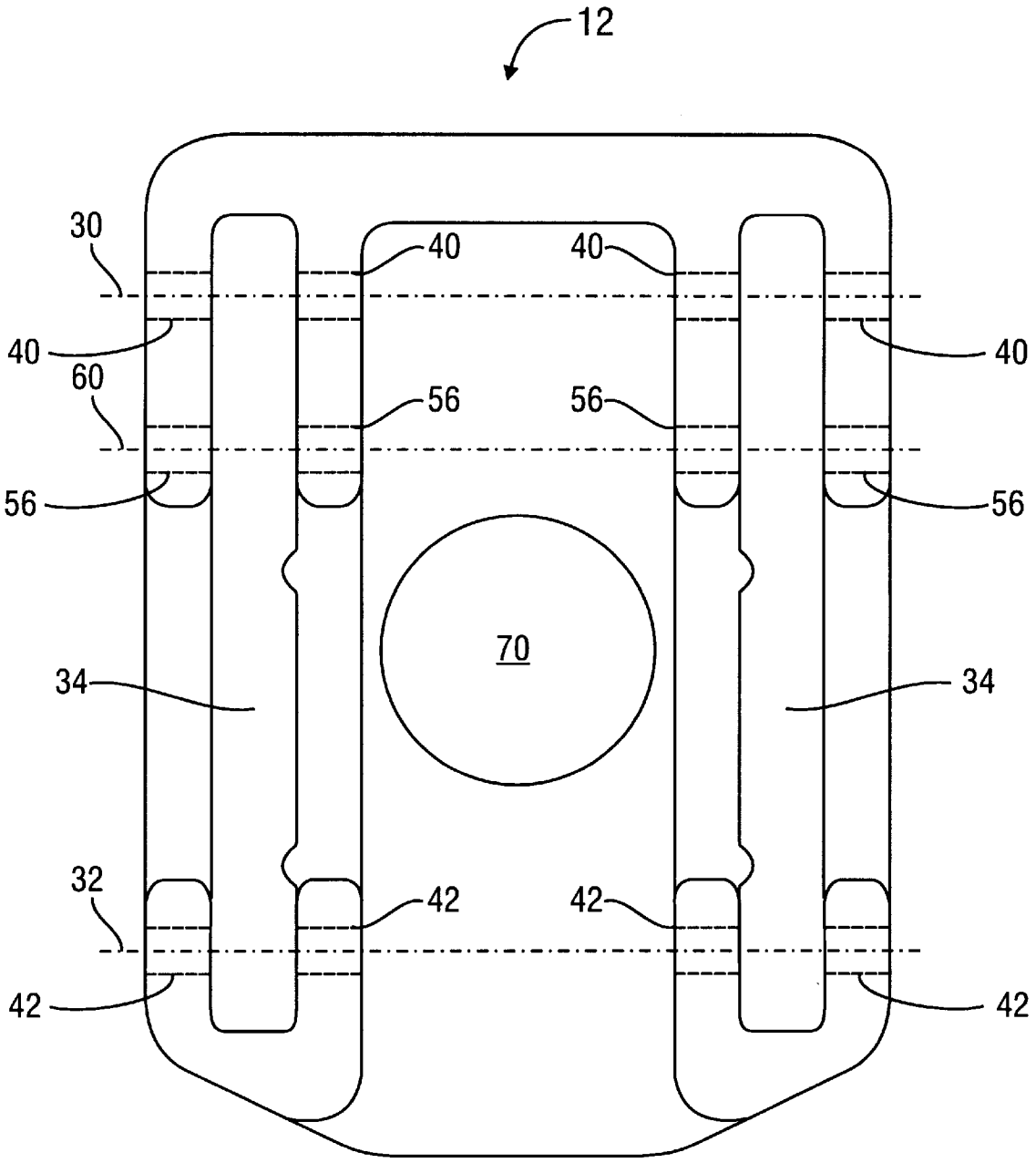
FIG. 2 is a plan view of an exemplary transom plate in accordance with an embodiment of the present invention.
Figure 3:
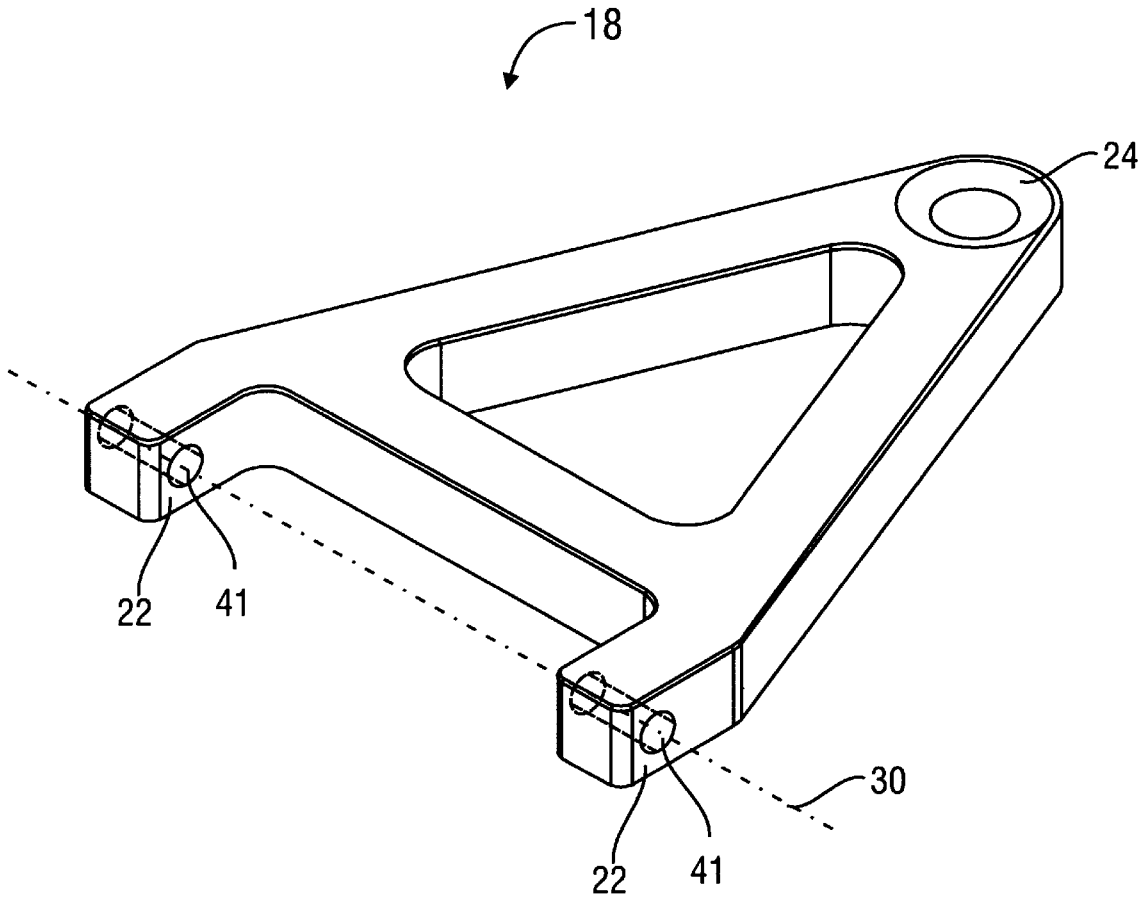
FIG. 3 is a perspective view of an exemplary embodiment of the first arm for a marine outdrive vertical trim system in accordance with the present invention.
Figure 4:
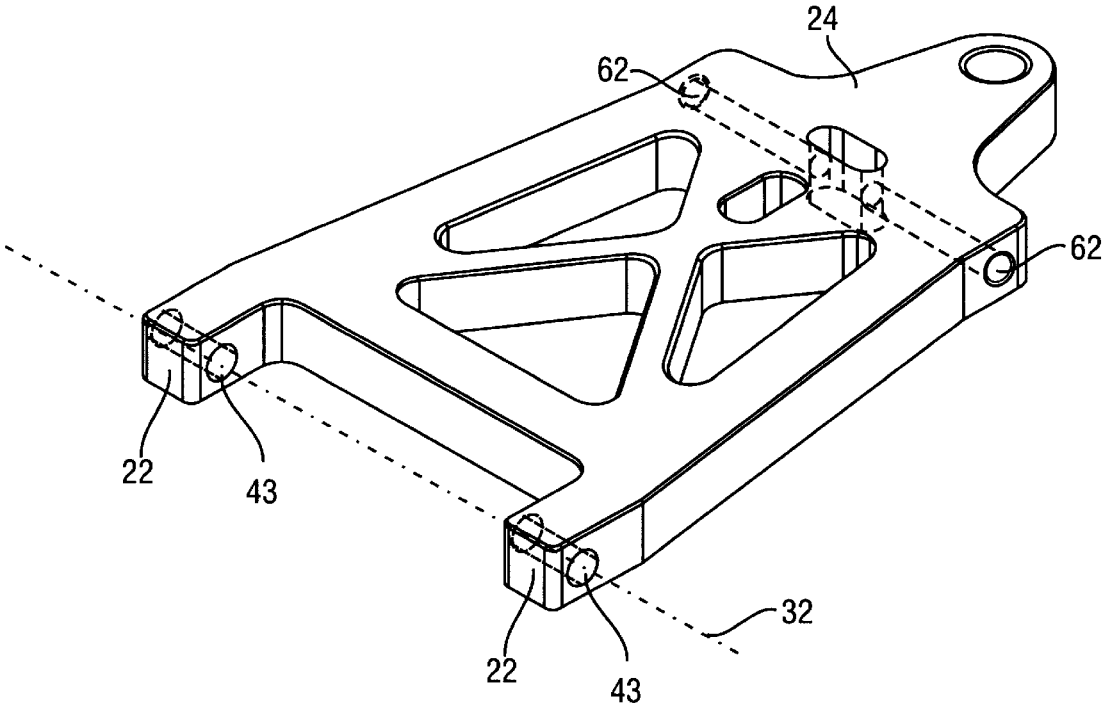
FIG. 4 is a perspective view of an exemplary embodiment of the second arm for a marine outdrive vertical trim system in accordance with the present invention.

FIG. 2 illustrates a plan view of one embodiment of the transom plate 12, and FIG. 3 and FIG. 4 illustrate perspective views of particular embodiments of the first arm 18 and the second arm 20, respectively. The embodiment of the transom plate 12 illustrated in FIG. 2, which may be fashioned out of aluminum, defines two channels 34 that are adapted to receive the ends 22 of the first and second arms 18, 20. The transom plate 12 further defines a plurality of bores 40, 42 that are coaxial with corresponding bores 41, 43, respectively, defined by the first and second arms 18, 20. The ends 22 of the first and second arms 18, 20 are seated within the channels 34, and pivot pins 44 are inserted through the bores 40–43 to couple the first and second arms 18, 20 to the transom plate 12. Hence, the first arm 18 may pivot about the first horizontal axis 30, and the second arm 20 may pivot about the second horizontal axis 32, allowing adjustment of the height of the ends 24 of the first and second arms 18, 20 relative to the transom plate 12.

The marine outdrive vertical trim system 10 may further include a device for selectively positioning the ends 24 of the first and second arms 18, 20, such that the height of an outdrive coupled thereto may be set at a desired position relative to the transom plate 12. In FIG. 1, an exemplary embodiment of such a device is illustrated, including two hydraulic cylinders 50, each having a first end 52 pivotally coupled to the transom plate 12 and a second end 54 coupled to the second arm 20. Thus, the hydraulic cylinders 50 may be extended or retracted through hydraulic fluid pressure to lower or raise, respectively, the ends 24 of the first and second arms 18, 20.

The embodiment of the device for selectively positioning the ends 24 of the first and second arms shown in FIG. 1 is further disclosed with reference to FIG. 2 and FIG. 4. The first ends 52 of the hydraulic cylinders 50 are seated within the channels 34 of the transom plate 12. The transom plate 12 defines bores 56 that are coaxial with corresponding bores (not shown) extending through the first ends 52 of the hydraulic cylinders 50. Pivot pins 58 extend through the bores 56 and the corresponding bores in the first ends 52 to pivotally couple the hydraulic cylinders 50 to the transom plate 12, such that the hydraulic cylinders 50 pivot about a third horizontal axis 60 that is generally parallel to the first and second parallel axes 30, 32. The second arm 20 defines bores 62 extending through the end 24, and the second ends 54 of the hydraulic cylinders 50 define corresponding openings 64, through which pivot pins 66 extend to couple the hydraulic cylinders 50 to the second arm 20.

The embodiment of the device for selectively positioning the ends 24 disclosed thus far is exemplary only, as it would be a routine undertaking for one skilled in the art having the benefit of this disclosure to configure alternate means for positioning the ends 24 of the first and second arms 18, 20. For example, the second ends 54 of the hydraulic cylinders 50 could be coupled to the first arm 18, rather than the second arm 20 as illustrated in FIG. 1, so that the ends 24 are raised when the hydraulic cylinders 50 are extended, and lowered when the hydraulic cylinders 50 are retracted.

Figure 5:
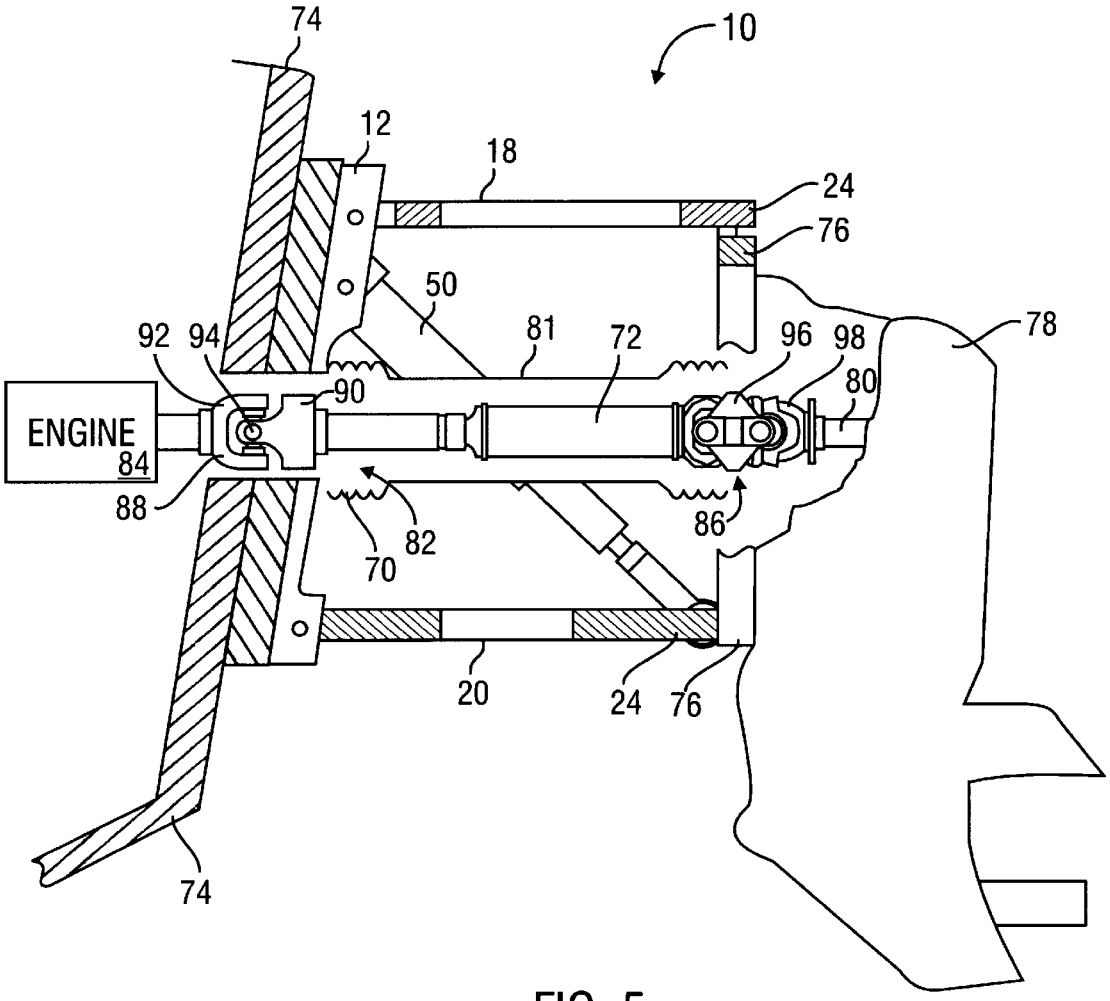
FIG. 5 is side elevation view, partially in section, of an embodiment of the vertical trim system for a marine outdrive, particularly illustrating an exemplary rotary driveshaft in accordance with the present invention.

The transom plate 12 further defines a generally transverse opening 70 through which a rotatable driveshaft 72 extends. FIG. 5 shows an embodiment of the vertical trim system 10, partially in section, illustrating a driveshaft 72 in accordance with an embodiment of the present invention. In the embodiment of FIG. 5, the transom plate 12 is shown mounted to a transom of a boat 74, and the ends 24 of the first and second arms 18, 20 are coupled to a gimbal ring 76 of an outdrive unit 78 that includes a propeller drive 80. A flexible tube 81 may surround the driveshaft 72 to provide a water tight seal between the outdrive unit 78 and the transom plate 12.

The driveshaft 72 includes a first end 82 that is adapted to be coupled to an engine 84 inside the boat 74. The driveshaft 72 further includes a second end 86 that is adapted to be coupled to the propeller drive 80 of the outdrive unit 78. In the embodiment illustrated in FIG. 5, the first end 82 of the driveshaft 72 is coupled to the engine 84 via a universal joint 88. A universal joint is used to couple misaligned rotatable shafts, such as the driveshaft 72. The universal joint 88 is of standard construction, including two opposed yokes 90, 92 coupled to a rotatable intermediate member 94. The yoke 90 may comprise a slip yoke, to allow the driveshaft 72 to lengthen or shorten during deflection motions.

The second end 86 includes a constant velocity joint 96 for connecting the driveshaft 72 to the propeller shaft 80 via a yoke 98. A constant velocity joint is a type of universal joint that provides constant angular velocity as the misalignment between connected shafts changes. The constant velocity joint 96 allows the outdrive 78 to be moved up and down vertically, while directing constant power transfer from the engine 84 to the propeller drive 80. Spicer 1310 or 1330 constant velocity joints, available from the Dana Corporation, Toledo, Ohio, are examples of suitable constant velocity joints for coupling the driveshaft 72 to the outdrive unit 78 in one embodiment of the invention. In an embodiment employing a Spicer 1310 constant velocity joint, the original Spicer 1310 yoke 98 is replaced by a modified yoke that is sized to be coupled to a Mercruiser Bravo or Blackhawk outdrive unit.

Figure 6:
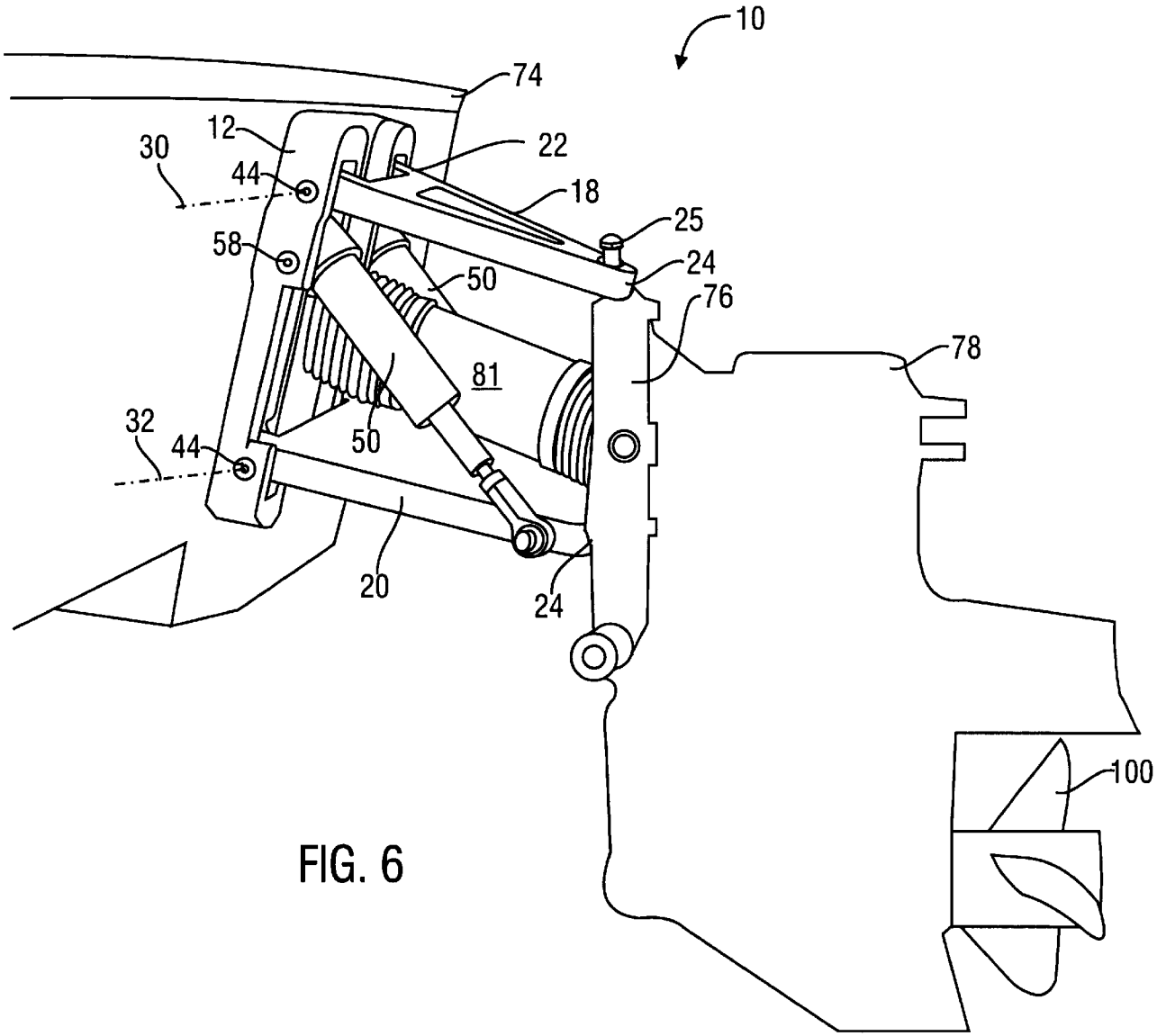
FIG. 6 is a perspective view of a vertical trim system for a marine outdrive in accordance with an embodiment of the present invention, shown coupled to the transom of a boat.

FIG. 6 is a perspective view of an embodiment of the marine outdrive vertical trim system, illustrating the transom plate 12 coupled to a boat 74 and the ends 24 of the first and second arms 18, 20 coupled to a gimbal ring 76 of an outdrive unit 78. The tube 81 surrounds the driveshaft 72 (not shown in FIG. 6), and is sealed to the transom plate 12 at one end, and sealed to the outdrive unit 78 at the other end, preventing water from entering the boat 74 or the outdrive unit 78. Further, the tube 81 flexes as the gimbal ring 76 pivots about a vertical axis for steering, or as the first and second arms 18, 20 change the height of the outdrive unit 78 relative to the transom plate 12.

In operation, when hydraulic pressure is applied such that the hydraulic cylinders 50 extend, the rear end 24 of the second arm 20 is moved in a downward motion while the front end 22 of the second arm 20 pivots on the transom plate 12 about the horizontal axis 32. The ends 24 of both the first and second arms 18, 20 are coupled to the gimbal ring 76; thus, the end 24 of the first arm 18 also moves downward, while the front end 22 of the first arm 18 pivots about the horizontal axis 30, which is generally parallel to the horizontal axis 32 about which the second arm 20 pivots.

When the first and second arms 18, 20 are moved downward, the gimbal ring 76 also moves in a downward motion, lowering the outdrive unit 78, and in turn, lowering the position of a propeller 100 coupled thereto, relative to the boat 74. When hydraulic pressure is applied to retract the hydraulic cylinders 50, the end 24 of the second arm 20 moves upwards, moving the gimbal ring 76, and in turn, the outdrive unit 78 and propeller 100. In one embodiment, the hydraulic cylinders 50 are configured to be remotely controlled by the boat driver while the boat 74 is underway. Configuring the hydraulic cylinders 50 for remote operation would be a routine undertaking for one skilled in the art having the benefit of this disclosure, and is not addressed in detail herein.

Thus, the marine vertical trim system of the present invention improves performance of marine crafts, particularly planing-type boat hulls, by providing a system for changing the vertical position of the boat's propeller 100 relative to the boat 74, after the outdrive unit 78 has been mounted to the boat 74. A boat driver may raise or lower the propeller height from the driver's helm as conditions warrant, to keep the propeller 100 at an optimum depth, thereby enhancing the boat's handing and performance.

The particular embodiments disclosed above are illustrative only, as the invention may be modified and practiced in different but equivalent manners apparent to those skilled in the art having the benefit of the teachings herein. For example, in the embodiments illustrated herein, two arms 18, 20 are provided, with the first arm 18 coupled to the transom plate 12 such that it is positioned above the second arm 20. Other quantities of arms and arrangements thereof could be employed to allow the gimbal ring to be moved in the up-and-down fashion disclosed herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A vertical trim system for a marine inboard-outboard outdrive, comprising:

a transom plate defining an opening therethrough and having first and second sides, the first side adapted to be mounted to a boat transom;

at least one arm having first and second ends, the first end being pivotally coupled to the second side of the transom plate, such that the at least one arm pivots about a horizontal axis;

the second end of the at least one arm being adapted to be pivotally coupled to a gimbal ring of an outdrive and a rotatable driveshaft extending through the transom plate opening and having first and second ends; the first end adapted to be coupled to an engine, the second end adapted to be coupled to said outdrive.

2. The vertical trim system of claim 1 wherein the at least one arm comprises first and second arms, the first ends of the first and second arms being pivotally coupled to the second side of the transom plate in spaced relationship, such that the first and second arms pivot about first and second horizontal axes, respectively; the first axis being generally parallel to the second axis.

3. The vertical trim system of claim 2 further comprising a device for pivoting at least one of the arms to selectively position the second end of the arms relative to the transom plate.

4. The vertical trim system of claim 2 wherein the first arm is positioned above the second arm.

5. The vertical trim system of claim 3 wherein the device for pivoting comprises at least one hydraulic cylinder having one end pivotally coupled to the transom plate, and another end coupled to the arm, such that the arm moves in a first direction when the hydraulic cylinder is extended and in a second direction when the hydraulic cylinder is retracted.

6. The vertical trim system of claim 5, wherein the hydraulic cylinder is pivotally coupled to the transom such that the hydraulic cylinder pivots about a third horizontal axis that is generally parallel to the first and second horizontal axes.

7. The vertical trim system of claim 3 further comprising a flexible tube surrounding the driveshaft.

8. The vertical trim system of claim 1 further comprising a universal joint coupled to the driveshaft first end.

9. The vertical trim system of claim 1 further comprising a constant velocity joint coupled to the driveshaft second end.

10. The vertical trim system of claim 1 wherein the driveshaft includes a slip yoke.

11. A marine outdrive system for an inboard-outboard propulsion unit, the outdrive system comprising:

a transom plate defining an opening therethrough and having first and second sides, the first side adapted to be mounted to a boat transom;

an outdrive unit having a gimbal ring;

a driveshaft having first and second ends, the first end adapted to extend through the transom plate opening and be coupled to an engine, the second end coupled to the outdrive unit via a constant velocity joint; and first and second arms each having first and second ends, the first ends being pivotally coupled to the second side of the transom plate in spaced relationship, such that the first and second arms pivot about first and second horizontal axes, respectively, the first axis being generally parallel to the second axis, the second ends of the first and second arms each being pivotally coupled to the gimbal ring.

12. The marine outdrive system of claim 11 further comprising a device coupled to at least one of the arms for selectively adjusting the position of the gimbal ring relative to the transom plate.

13. The marine outdrive system of claim 12 wherein the device for selectively adjusting the position of the gimbal ring comprises at least one hydraulic cylinder having one end pivotally coupled to the transom plate, and another end coupled to the second arm, such that the second arm moves in a first direction when the hydraulic cylinder is extended and in a second direction when the hydraulic cylinder is retracted.

14. A method for adjusting the depth of an outdrive propeller for an inboard-outboard boat propulsion system including a transom plate coupled to a boat transom, an engine mounted inside the boat, and a gimbal ring pivotally coupled to the outdrive, the method comprising the acts of:

coupling one end of a driveshaft to the engine via a universal joint; passing the other end of the driveshaft through an opening in the transom plate and coupling said other end to the outdrive via a constant velocity joint; pivotally coupling one end of an arm to a location on the transom plate and the other end to the gimbal ring; and pivoting the arm about the location on the transom plate to adjust the height of the outdrive.

15. The method of claim 14 wherein the pivoting act comprises pivoting the arm while the boat is underway.

16. A marine outdrive system for an inboard-outboard propulsion unit, the outdrive system comprising:

an outdrive unit having a gimbal ring;

a transom plate adapted to be coupled to a boat transom, a driveshaft having first and second ends, said first end adapted to extend through an opening in the transom plate and be coupled to an engine;

first means for coupling the driveshaft second end to the outdrive unit; and second means for varying the height of the outdrive unit.

17. A marine system comprising:

a boat having a transom and an engine;

an inboard-outboard outdrive having a gimbal ring;

a transom plate defining an opening therethrough and having first and second sides, the first side mounted to the boat transom;

at least one arm having first and second ends, the first end being pivotally coupled to the second side of the transom plate, such that the at least one arm pivots about a horizontal axis;

the second end of the at least one arm being pivotally coupled to the gimbal ring of the outdrive; and a rotatable driveshaft extending through the transom plate opening and having first and second ends; the first end being coupled to the engine, the second end being coupled to said outdrive.

18. A drive system for a boat, comprising:

a transom plate defining an opening therethrough and having first and second sides, the first side adapted to be mounted to a boat transom;

at least one arm having first and second ends, the first end being pivotally coupled to the second side of the transom plate, such that the at least one arm pivots about a horizontal axis;

an outdrive unit having a gimbal ring, wherein the second end of said at least one arm is pivotally coupled to said gimbal ring; and a rotatable driveshaft extending through the transom plate opening and having first and second ends; the first end adapted to be coupled to an engine, the second end coupled to said outdrive.

* * * * *